United States Patent [19]

Wakeman et al.

[11] 4,277,016

[45] Jul. 7, 1981

[54] ENVELOPE ASSEMBLY

[75] Inventors: William R. Wakeman; Edmund G. Van Malderghem; Kenneth R. Greulich, all of Niagara County, N.Y.

[73] Assignee: Moore Business Forms, Grand Island, N.Y.

[21] Appl. No.: 71,490

[22] Filed: Aug. 31, 1979

Related U.S. Application Data

[62] Division of Ser. No. 895,451, Apr. 11, 1978.

[51] Int. Cl.[3] ..... B65D 27/10

[52] U.S. Cl. ..... 229/69; 229/80

[58] Field of Search ..... 229/69, 80; 282/11.5 A, 282/11.5 R, 25

[56] References Cited

U.S. PATENT DOCUMENTS

| | | | |
|---|---|---|---|
| 2,209,601 | 7/1940 | Heywood | 229/80 X |
| 3,325,188 | 6/1967 | Hiersteiner | 229/69 X |
| 3,339,827 | 9/1967 | Steidinger | 229/69 |
| 3,482,780 | 12/1969 | Johnsen | 229/69 |
| 3,941,308 | 3/1976 | DiGirolomo et al. | 229/69 |
| 4,010,889 | 3/1977 | Allen et al. | 229/69 |
| 4,108,352 | 8/1978 | Peschke | 229/69 |
| 4,166,539 | 9/1979 | Allen et al. | 229/69 |

*Primary Examiner*—Stephen P. Garbe

*Attorney, Agent, or Firm*—Watson, Cole, Grindle & Watson

[57] ABSTRACT

A stuffed sealed envelope assembly has a free insert immobilized therein against shifting by means of adhering material provided on confronting surfaces both the front and back of the envelope and so characterized that the material will stick only to itself and not to the insert. Such material is placed in contact with the insert while remaining unattached therefrom so as to snugly hold the insert in registry within the envelope. Removal of an envelope stub facilitates opening and extraction of the insert.

2 Claims, 17 Drawing Figures

ENVELOPE ASSEMBLY

This is a division of application Ser. No. 895,451, filed Apr. 11, 1978.

BACKGROUND OF THE INVENTION

This invention relates generally to a self-sealed envelope assembly having a free insert therein, and more particularly to such an assembly wherein the insert is immobilized in place by means of self-adhering material at least partially securing the envelope plies together and in contact with the insert.

Various types of stuffed sealed envelopes having free inserts therein are known from the prior art. For example, U.S. Pat. No. 4,010,889, commonly owned herewith, discloses a free insert immobilized in place within the outer envelope plies by means of retention chips bearing against opposed side and end edges of the insert. U.S. Pat. No. 3,777,971 discloses a free insert being held in place within a stuffed sealed envelope by means of embossments struck from one of the outer envelope plies and presenting shoulders abutting against edges of the insert. Still further, in U.S. Pat. No. 3,339,827, a free insert is immobilized within a stuffed sealed envelope by means of adhesive used in securing the outer envelope plies together.

All three of these constructions, however, are to some degree difficult to assemble because of the production accuracy required in assuring that the insert may be extracted without interference. This is a particular problem in the assembly of continuous envelopes in accordance with the aforementioned U.S. Pat. No. 3,339,827 patent since even a small portion of the glue used in securing the outer envelope plies together will render the insert difficult to extract if the glue touches any portion of the insert. Hence, extreme care must be taken during manufacture of the envelope assemblies in assuring that the glue streams are spaced a slight distance away from the peripheral edge of the insert so that such edges are unattached to the glue, as required.

Other prior art relating to the invention may be found in U.S. Pat. Nos. 3,208,662 and 3,208,663 wherein self-stick adhesive is utilized for retaining fold-flap envelopes onto a support web without the adhesive sticking to the envelopes themselves. Neither patent, however, discloses a stuffed sealed envelope assembly as in the invention.

SUMMARY OF THE INVENTION

It is an object of the present invention to provide a stuffed sealed envelope assembly having a free insert maintained in registry therein without shifting relative to the outer envelope plies, the construction of such envelope assembly avoiding the difficulties during production and insert extraction experienced with prior art stuffed sealed envelope assemblies having free inserts.

Another object of this invention is to provide such a stuffed sealed envelope assembly capable of being manufactured quickly and economically as the inserts are placed in contact with the means securing the outer envelope plies together yet remain unattached to such means so as to provide a snug peripheral embrace of the insert and at the same time insure easy insert extraction without interference.

To this end, the stuffed sealed envelope assembly is constructed according to one embodiment of the invention with outer envelope plies secured together by means such as a self-stick adhesive applied inwardly and outwardly of edges of the insert so as to immobilize the insert in place without shifting relative to the plies, the insert thereby being in contact with such adhesive but unattached thereto. The insert may therefore be quickly and easily extracted without interference upon the removal of an envelope stub.

A further object of the present invention is to provide such a stuffed sealed envelope assembly containing a free insert wherein the outer envelope plies are adhesively secured together in the customary manner along only one pair of opposite ends, the plies being further secured together at the other pair of opposite ends thereof by means such as self-stick adhesive applied inwardly and outwardly of adjacent edges of the insert so as to immobilize the insert in place without shifting relative to the plies. The insert is therefore in contact only with the self-stick adhesive but remains unattached thereto so that it may be effectively extracted without interference upon removal of an envelope stub.

A still further object of this invention is to provide such a stuffed sealed envelope assembly containing a free insert wherein the outer envelope plies are secured together in the customary manner along peripheral glue lines to form an envelope pocket for the insert, means such as self-stick adhesive lying between the glue lines and at least a pair of opposite edges of the insert, such means further extending inwardly of such opposite edges for immobilizing the insert in place.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4, 5, 6:
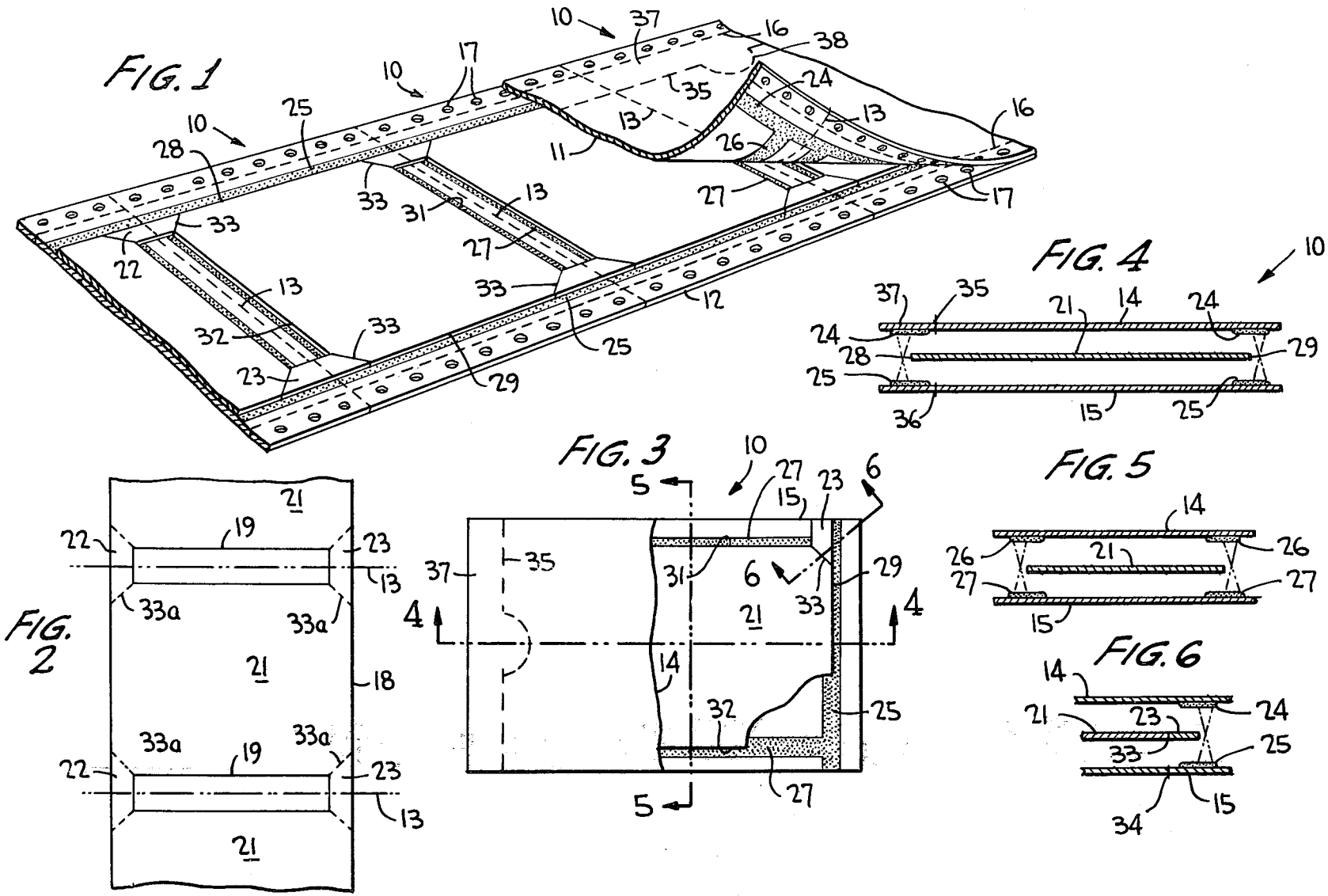
FIG. 1 is a perspective view of series-connected envelopes constructed according to one embodiment of the invention with a portion thereof broken away for clarity.
FIG. 2 is a plan view of an intermediate web forming insert sheets within the series-connected envelope assemblies of FIG. 1.
FIG. 3 is a slightly enlarged plan view of an individual envelope of the FIG. 1 assembly with the feed bands removed and being partly broken away for clarity.
FIGS. 4, 5 and 6 are sectional views taken respectively along lines 4—4, 5—5 and 6—6 of FIG. 3.

Turning now to the drawings wherein like reference characters refer to like and corresponding parts throughout the several views, a continuous series of stuffed sealed envelope assemblies generally designated 10 are shown in FIG. 1 as constructed of superimposed continuous upper and lower plies 11 and 12 having spaced cross lines 13 of weakening therein so as to respectively define envelope front and back sheets 14 and 15 (FIGS. 3 to 6). Superimposed longitudinal lines 16 of weakening are provided in the upper and lower plies near opposite edges so as to define removable feed bands having spaced feed holes 17 therein.

A continuous intermediate web 18, shown in FIG. 2, is disposed between the upper and lower plies and has die cuts 19 formed therein extending along opposite sides of lines 13 of weakening. The die cuts thereby define a series of insert sheets 21 having connecting portions 22 and 23 between adjoining sheets at opposite ends of the die cuts.

Plies 11 and 12 are respectively provided with confronting strips of securing means 24 and 25, such as self-stick adhesive, along opposing side edges thereof. Strips 26 and 27 are likewise provided on the inner surfaces of the upper and lower plies in confronting relationship along and spaced slightly inwardly of cross lines 13 of weakening. These strips may likewise comprise self-stick adhesive which, together with strips 24 and 25, may be of the conventional latex adhesive which adhere on contact or the heat sealing adhesive variety such that confronting strips will adhere only to each other at elevated temperatures but not to the insert sheets of the intermediate ply as will be hereinafter more fully described. Such adhesive may therefore be active by simple contact or activated by pressure, by heat, or such self-stick adhesive may be of the type which is activated by remoistening or the type activated by radiation. Moreover, such confronting strips of securing means may include material such as polyethylene which is activated upon application of heat thereto.

Strips 24 and 25 are disposed along opposite side edges 28 and 29 of inserts 21 and are of sufficient width as to lie both inwardly and outwardly of these side edges (FIGS. 3 and 4). Likewise, confronting strips 26 and 27 of the securing means lie along opposing end edges 31 and 32 of the inserts and are of sufficient width as to lie both inwardly and outwardly of these end edges, as seen in FIGS. 1, 3 and 5. Hence, by the nature of such confronting strips of adhering means, strips 24 and 25 adhere only to each other and not to any portion of the inserts along opposite edges 28 and 29. Likewise, confronting strips 26 and 27 adhere only to each other and to no portion of the inserts along opposing end edges 31 and 32. Each insert 21, as shown for envelope assembly 10 of FIG. 3, is thereby immobilized between the envelope front and back while being in contact with the strips of securing means, but unattached thereto.

As in the aforementioned commonly owned U.S. Pat. No. 3,339,889 patent, connections 22 and 23 are severed from the inserts during some convenient stage of the web processing operation. Such may be carried out by cutting connections 22 and 23 along lines 33*a*, shown in dotted outline in FIG. 2, so as to produce clean cuts 33. These cuts may be made through one of the outer plies such as lower ply 12, as shown at 34 in FIG. 6, thereby serving the dual purpose of severing connections 22 and 23 from the insert sheets, and permitting any entrapped air within the sealed envelope assembly to escape. A completely flat envelope assembly is therefore made possible so as to avoid the "pillowed effect" normally occuring during the production of sealed envelopes.

Longitudinal lines 35 and 36 of weakening are respectively provided in the upper and lower plies at one end of the envelope assemblies slightly inwardly of strips 24 and 25 of the securing means. A stub 37 is therefore produced which, upon removal, will serve to open the envelope and extract the insert sheet. Thumb notch 38 may be formed at lines 35 and 36 to facilitate easier grasping of the stub which overlaps an end portion of the insert sheet.

From the foregoing it can be seen that the envelope assemblies produced according to the aforedescribed embodiment include free inserts which are maintained in registry between the envelope front and back without shifting relative thereto since strips 24 and 26 of the securing means respectively confronting strips 25 and 27 of the securing means are activated when brought into contact with one another, although the securing means is such that it will not adhere to any portion of the insert despite being in contact therewith. The inserts nevertheless remain unattached to the confronting strips of securing means. Such an arrangement is graphically illustrated in FIGS. 4 and 5 where, for purposes of the description, the inserts are shown spaced from the strips of securing means when in fact they are in contact therewith but remain nevertheless unattached thereto. The insert is accordingly maintained in a desired registration position within the envelope during processing thereof through the computer printing equipment.

Figures 7, 8, 9, 10, 11:
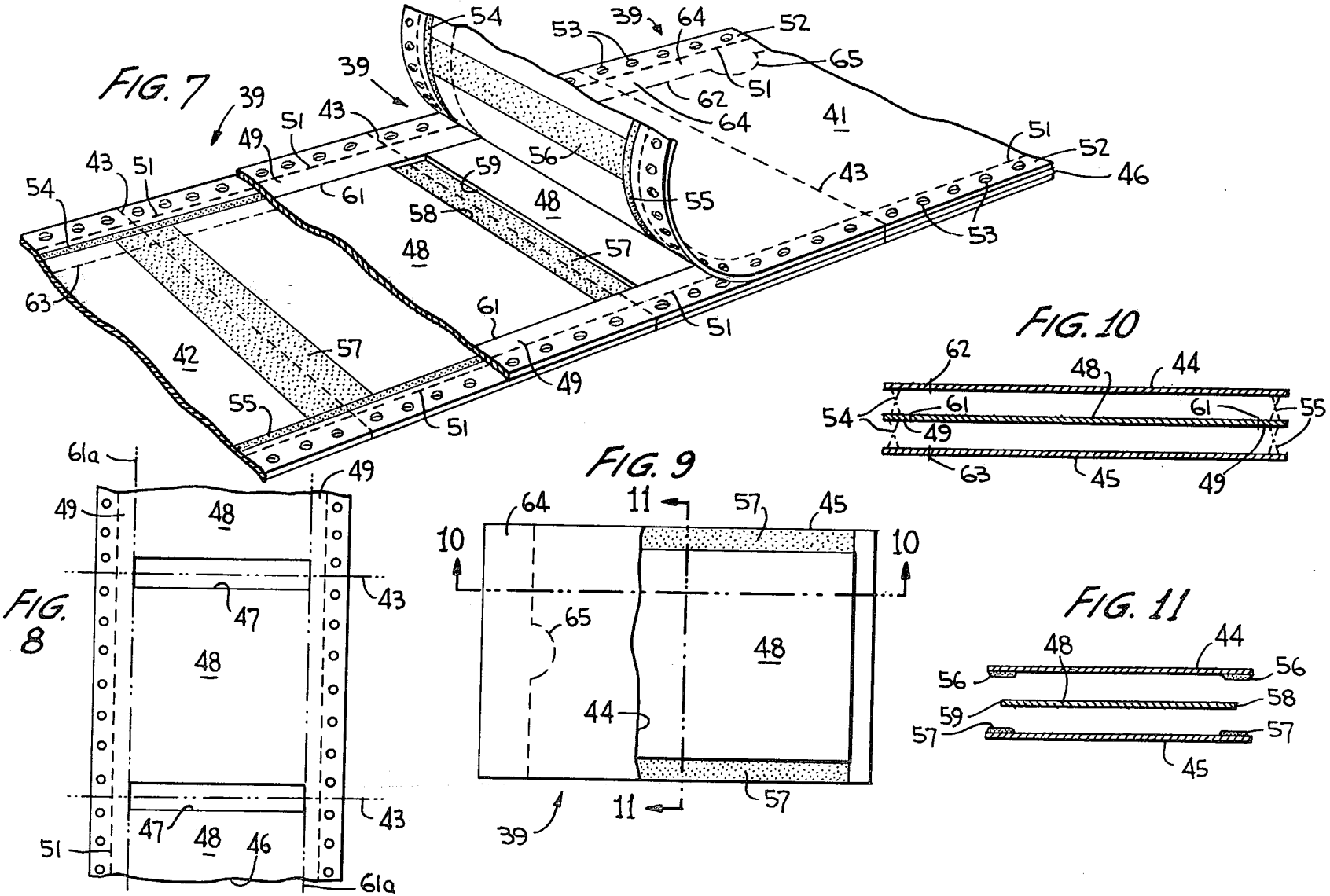
FIG. 7 is a view similar to FIG. 1 of another embodiment of the present invention.
FIG. 8 is a plan view of an intermediate web forming insert sheets within the series-connected envelope assemblies of FIG. 7.
FIG. 9 is a slightly enlarged plan view of an individual envelope of the FIG. 7 assembly with the feed bands removed and being partly broken away for clarity.
FIGS. 10 and 11 are sectional views respectively taken along lines 10—10 and 11—11 of FIG. 9.

In another embodiment according to the invention, a continuous series of stuffed sealed envelope assemblies generally designated 39 are shown in FIG. 7 as constructed of superimposed continuous upper and lower plies 41 and 42 having spaced transverse lines 43 of weakening therein for delimiting envelope front and back sheets 44 and 45 (FIGS. 9 to 11).

A continuous intermediate ply 46 is located between the upper and lower plies and has die cuts 47 formed therein (see FIG. 8) at spaced locations so as to extend along opposite sides of transverse lines 43. These lines are likewise provided in the remainder of intermediate ply 46 in superimposed relationship with such lines provided in the upper and lower plies, so as to thereby define together with the die cuts a series of insert sheets 48 held together by connecting portions 49 at opposite ends of the die cuts. And, superimposed longitudinal lines 51 of weakening are provided in each of the plies along opposite longitudinal edges for delimiting feed bands 52 having spaced feed holes 53 therein for engaging the pins of a tractor pin feed device of web processing equipment.

The upper, intermediate and lower plies are interconnected together by means of longitudinal glue streams 54 and 55 lying inwardly of lines 51 of weakening. As seen in FIG. 10, these glue streams interconnect portions 49 of the intermediate ply with the upper and lower plies. And, the upper and lower plies 41 and 42 are respectively provided with confronting portions 56 and 57 of securing means, such as self-stick adhesive, along transverse lines 43 of weakening and extending between glue streams 54 and 55. These adhesive portions are of the same type of self-stick adhesive as described earlier with reference to securing strips 24 to 27. And, as shown in FIGS. 7 and 11, such adhesive portions are of sufficient width as to lie both inwardly and outwardly of opposing side edges 58 and 59 of insert sheets 48. Therefore, due to the particular characterization of confronting adhesive portions 56 and 57, they adhere only to each other and not to any portion of the insert sheets along opposing edges 58 and 59. And, it should be pointed out that portions 56 and 57 need not be applied in continuous cross strips to the upper and lower plies as shown in FIG. 7, but may instead be formed as a plurality of adhesive spots extending both inwardly and outwardly of opposing edges 58 and 59 of the inserts, without departing from the invention. Such portions could likewise be applied to the upper and lower plies respectively as an interrupted longitudinal stream or as several interrupted longitudinal streams between glue streams 54 and 55.

Connecting portions 49 are severed from the inserts during some convenient stage of the web processing operation, similarly as described for connections 22 and 23 shown in the aforedescribed embodiment. Connecting portions 49 may be separated from the insert sheets by cutting along lines 61*a*, shown in phantom outline in FIG. 8, so as to produce clean cuts 61. The severed connecting portions 49 therefore define chip elements abutting opposite ends of the inserts for immobilizing them between the upper and lower plies together with confronting adhesive portions 56 and 57.

Longitudinal lines 62 and 63 of weakening are respectively provided in the upper and lower plies at one end of the envelope assemblies slightly inwardly of one of the feed strips 52 and inwardly of the adjacent end edges defined by cuts 61 of the inserts to thereby define a stub 64 which, upon removal, will serve to open the envelope and extract the insert sheet. A thumb notch 65 may be formed at lines 62 and 63 so as to further overlap the insert sheet of each assembly thereby facilitating easier grasping of the stub.

The envelope assemblies produced in accordance with the FIGS. 7 to 11 construction include free and unattached inserts held in a desired registration position between the fronts and backs of the envelopes by means of contacting securing portions 56 and 57 preventing the inserts from shifting longitudinally during web processing. And, any side shifting tendency is prevented by chip elements 49, although it should be pointed out that such side shifting is not likely to occur even without the provision of chips 49 since the snug embrace between the inserts and securing means 56 and 57 is sufficient to maintain the insert sheets in accurate registry within the envelope pockets of the assemblies.

Figures 12, 13, 14, 15, 16, 17:
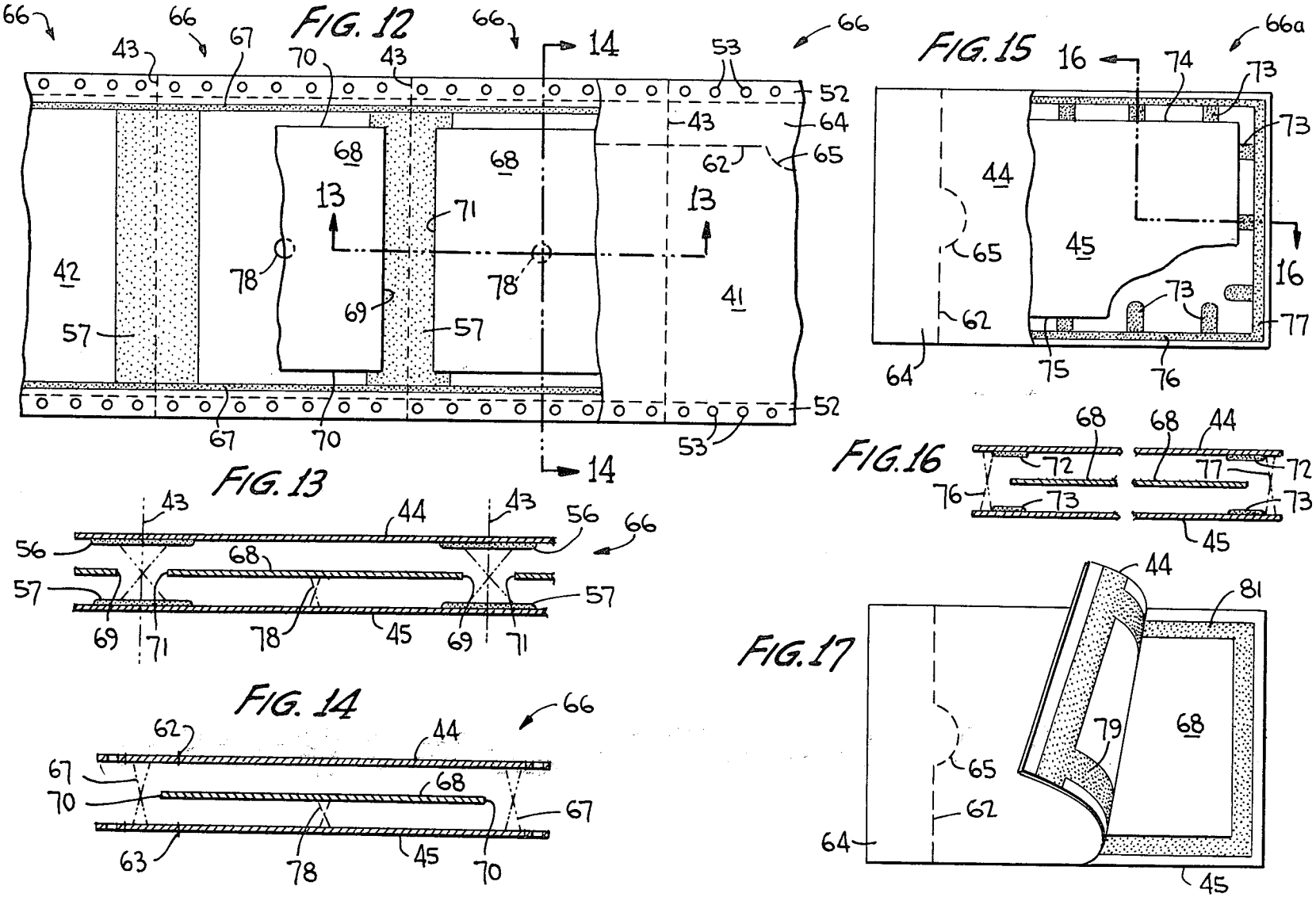
FIG. 12 is a top plan view of series-connected envelopes constructed according to yet another embodiment of the invention, parts thereof being broken away for clarity.
FIGS. 13 and 14 are sectional views respectively taken along lines 13—13 and 14—14 of FIG. 12.
FIG. 15 is a top plan view, partly broken away, of an individual envelope of still another embodiment of the invention.
FIG. 16 is a sectional view taken substantially along line 16—16 of FIG. 15.
FIG. 17 is a top plan view of an individual envelope, with its front peeled back for clarity, of yet another embodiment of the invention.

In accordance with yet another embodiment of the invention, series-connected envelope assemblies 66 are constructed similarly as described with reference to FIG. 7. Thus, like elements will be similarly designated. As seen in FIGS. 12 and 14, the upper and lower plies are interconnected directly together by means of longitudinal glue streams 67 lying inwardly of adjacent feed bands 52. Otherwise, these plies are further interconnected similarly as in FIG. 7 by means of glue portions 56 and 57 respectively provided thereon and brought into contact with one another to effect the securement. The principle difference between assemblies 66 and 39 is that the former, as shown in FIG. 12, have no intermediate ply as part of the construction. Instead, a series of insert sheets 68 are disposed between the upper and lower plies and are mechanically held in place in some desired manner until adhesive portions 56 and 57 are brought into contact with one another. As before, such adhesive portions extend both inwardly and outwardly of opposing edges 69 and 71 of the inserts for snugly embracing the insert sheets to prevent longitudinal shifting thereof within the envelope pockets. Insert sheets 68 have their opposed side edges 70 spaced inwardly of glue streams 67 completely out of contact and attachment therewith. And, since adhesive portions 56 and 57 extend between glue streams 67, confronting parts thereof extend both inwardly and outwardly of side edges 70 to thereby prevent any side shifting of the inserts within the envelope pockets.

In accordance with yet another embodiment of the invention, envelope assemblies 66*a* are constructed similarly as assemblies 66 in FIG. 12 except that self-stick adhesive portions in the form of adhesive dots 72 and 73 are, as shown in FIGS. 15 and 16, provided along the periphery of insert sheet 45 and extend both inwardly and outwardly of the peripheral edges thereof. As before, when portions 72 and 73 are contacted together they adhere only to each other and not to any portion of the insert sheet although such adhesive portions are in contact therewith. The insert sheet is therefore fully immobilized within the envelope pocket of the assembly. However, these spots 72 and 73 of adhesive may be provided only at opposing edges 74 and 75 of the insert without departing from the invention. The envelope front and back 44 and 45 are further secured together along the periphery thereof by means of continuous conventional glue streams 76 and 77 lying outwardly of adhesive spots 72 and 73 for securing the fronts and backs together without interruption.

Alternatively, uninterrupted lines or streams of self-stick adhesive 79 and 81 may be applied in confronting relationship to the envelope front and back 44 and 45 along the entire periphery of the insert 68, as shown in FIG. 17, for both securing the outer envelope parts together and for maintaining the insert in registry therein. Such adhesive streams, similarly as spots 73 of the FIG. 15 construction, extend both inwardly and outwardly of the peripheral edges of the insert. Therefore, when the self-stick adhesive streams 79 and 81 are brought into contacting relationship, the envelope fronts and backs are secured together, the insert is brought into contact with such adhesive lines but remains unattached thereto or to any other portion of the envelope as a free insert in a registered position.

In positioning insert sheets 68 in place between the outer plies it may be desirable to provide a temporary adhesive spot 78 for temporarily interconnecting the inserts to the back sheets 45. Then, after the inserts are permanently immobilized between the outer plies by the self-stick portions 56 and 57, as aforedescribed, the temporary adhesive spots may be released by drying, heat, cooling, radiation, flexing, impact or other physical or chemical changes depending on the characteristics of the temporary glue spot.

The insert material within the envelopes of each embodiment is illustrated as single sheets although it should be recognized that such insert material may comprise several insert sheets, or several of such sheets including a return envelope, without departing from the scope of the present invention.

In operation, the recipient of any envelope assembly 10, 39, 66 or 66*a* simply grasps the removable stub with one hand and an opposite end of the envelope outwardly of the opposing side edge of the insert with the other hand, and moves his hands in a direction away from one another in a snapping action so as to cause the envelope to be opened upon removal of the stub and simultaneously extract the insert. Since the insert is completely unattached to any portion of the front or back of the envelope or to any of the strips or spots of securing means, it is removed from the envelope smoothly and efficiently without any interference. It can be seen that care need not be exercised in disposing the strips of securing means relative to the edges of the inserts since the self-stick feature of the securing means prevents any adherence whatsoever with the insert.

Obviously, many modifications and variations of the present invention are made possible in light of the above teachings. It is therefore to be understood that within the scope of the appended claims the invention may be practiced otherwise than as specifically described.

We claim:

1. An assembly of stuffed, sealed envelopes, comprising, superimposed upper, intermediate and lower continuous plies respectively defining envelope fronts, inserts and envelope backs series-connected together along spaced cross lines of weakening in said plies, said intermediate ply having diecuts at said lines of weakening so as to define opposed side edges of said inserts spaced inwardly of said lines of weakening and initially defining connecting portions between said inserts, opposed end edges of said intermediate ply lying inwardly of opposed end edges of said upper and lower plies, first and second sealing means of like material in confronting relationship on said front and back plies, said material being characterized so as to adhere only to itself upon said first and second means contacting one another, said connecting portions being severed from said inserts by cuts extending through one of said upper and lower plies so as to completely free said inserts from attachment to one another, said material lying both outwardly and inwardly of said side and end edges, said material which lies outwardly of said edges adhering to itself for securing said fronts and backs together to form envelope pockets for said inserts, said material contacting said inserts without being attached thereto for snugly holding said inserts in place without shifting between said fronts and backs while said envelopes are series-connected together as well as after said envelopes are detached from one another, and means on said fronts and backs for opening the envelope pockets and extracting said inserts.

2. The assembly according to claim 1, wherein said material comprises self-stick adhesive.

* * * * *